US006039507A

United States Patent [19]

Kennelly et al.

[11] Patent Number: 6,039,507

[45] Date of Patent: Mar. 21, 2000

[54] METHOD AND DEVICE FOR ASSEMBLING CLUSTER PLATFORMS

[75] Inventors: Kevin Kennelly, Jakarta Selatan; Ian Gardiner, South Jakarta, both of Indonesia; David Noble, Plano, Tex.; Achmad R. Muliadiredja, Pondok Gede, Indonesia

[73] Assignee: Atlantic Richfield Company, Los Angeles, Calif.

[21] Appl. No.: 09/105,650

[22] Filed: Jun. 26, 1998

[51] Int. Cl.[7] ..... E02B 17/00; E02B 17/02

[52] U.S. Cl. ..... 405/227; 405/195.1; 405/224

[58] Field of Search ..... 405/227, 205, 405/206, 208, 195.1; 52/638, 645, 650.1

[56] References Cited

U.S. PATENT DOCUMENTS

| | | | |
|---|---|---|---|
| 3,093,972 | 6/1963 | Ward | 405/227 X |
| 3,670,471 | 6/1972 | Smith | 52/638 |
| 4,633,566 | 1/1987 | Coppa | 52/638 X |
| 4,721,416 | 1/1988 | Gracia | 405/227 |
| 4,812,080 | 3/1989 | Urquhart et al. | 405/227 |
| 4,932,811 | 6/1990 | Folding | 405/227 |
| 4,949,516 | 8/1990 | Long | 52/645 |
| 5,012,875 | 5/1991 | Casbarian et al. | 405/227 X |
| 5,042,960 | 8/1991 | Tawfik et al. | 405/227 |
| 5,051,036 | 9/1991 | Gomez De Rosas et al. | 405/227 |
| 5,356,239 | 10/1994 | Canton | 405/227 |

FOREIGN PATENT DOCUMENTS

| | | | |
|---|---|---|---|
| 9008232 | 7/1990 | WIPO | 405/227 |

*Primary Examiner*—Dennis L. Taylor
*Attorney, Agent, or Firm*—F. Lindsey Scott

[57] ABSTRACT

A method for assembling a cluster platform in a body of water, by embedding a plurality of conductors in soil underlying the body of water; wet welding in the body of water at least one bracing element between the plurality of conductors, wherein the bracing element is wet welded to at least a first conductor of the plurality of conductors at a first elevation and wet welded to at least a second conductor of the plurality of conductors at a second elevation different from the first elevation; securing a deck atop the plurality of conductors.

7 Claims, 3 Drawing Sheets

METHOD AND DEVICE FOR ASSEMBLING CLUSTER PLATFORMS

FIELD OF THE INVENTION

The invention relates generally to a method and device for assembling cluster platforms and, more particularly, to such a method and device for assembling cluster platforms underwater.

BACKGROUND OF THE INVENTION

The concept of clustering oil and/or gas conductors with set dimensions between them to form the vertical legs of an offshore production facility structure (a "cluster" platform) is well known. Conventionally, cluster platforms are assembled onshore and transported across a body of water, and positioned and installed by a crane barge offshore.

Such a method of assembling and positioning cluster platforms, however, requires substantial installation time and expense. In an attempt to reduce the required installation time and expense, cluster platforms have been assembled offshore (i.e., underwater) by driving conductors into the floor of a body of water, and then spreading, or opening up, the conductors sufficiently to position prefabricated horizontal bracing elements between the conductors at various elevations. Long-bolt, friction-type clamps attached to the ends of the bracing elements are then clamped to the conductors to secure them in place. While the use of such prefabricated bracing elements and clamps reduces the time required to assemble cluster platforms, they are prohibitively expensive.

Accordingly, a continuing search has been directed to the development of systems and devices which can be used to more quickly and more economically assemble offshore cluster platforms.

SUMMARY OF THE INVENTION

According to the present invention, the time and cost of assembling an offshore cluster platform in a body of water is reduced by embedding a plurality of conductors in soil underlying the body of water; wet welding in the body of water at least one bracing element between the plurality of conductors, wherein the bracing element is wet welded to at least a first conductor of the plurality of conductors at a first elevation and wet welded to at least a second conductor of the plurality of conductors at a second elevation different from the first elevation; and securing a deck atop the plurality of conductors.

The present invention also provides for a device for bracing together a plurality of conductors in a body of water, wherein the device comprises a plurality of split sleeves, each of which are configured for matingly engaging one of the plurality of conductors; and a plurality of longitudinal members each of which has a first end rigidly connected to a first one of the plurality of split sleeves, and a second end rigidly connected to a second one of the plurality of split sleeves, such that an angle of less than 90° is formed between a centerline of at least one of the plurality of longitudinal members and a centerline of at least one of the plurality of split sleeves.

DESCRIPTION OF THE PREFERRED EMBODIMENT

Figure 1:
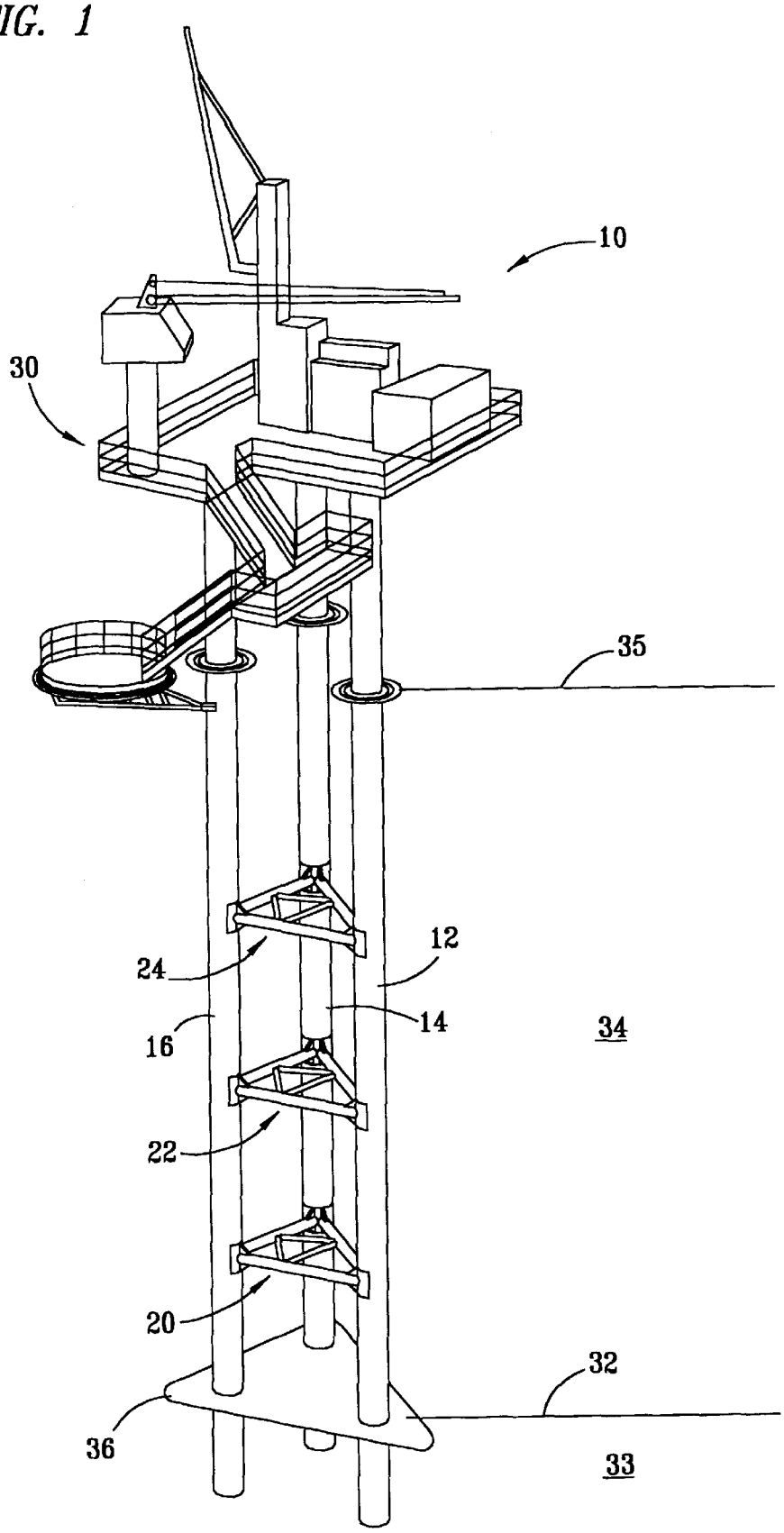
FIG. 1 is a perspective view of a cluster platform embodying features of the present invention.

In the discussion of the Figures the same reference numerals will be used throughout to refer to the same or similar components.

Referring to FIG. 1 of the drawings, the reference numeral 10 generally designates an offshore production facility structure, referred to hereinafter as a "cluster platform", embodying features of the present invention. As described in greater detail below, the cluster platform 10 comprises three spaced tubular vertical legs 12, 14, and 16 secured together with three spaced prefabricated bracing elements 20, 22, and 24 which together form a structure for supporting a production deck 30. The vertical legs 12, 14, and 16 also constitute conductors for the cluster platform 10, and will be referred to hereinafter as "conductors", through which conductors production tubing may be run in a manner well known in the art for producing oil and gas.

In addition to providing structural support for the cluster platform 10, the conductors 12, 14, and 16 also provide an embedded soil pile foundation for the platform 10. To provide a safe foundation load capacity and factor of safety against loads applied to the structure, the conductors 12, 14, and 16 penetrate a surface 32 of a seabed floor, soil, or the like, hereinafter referred to as soil 33, beneath a body of water 34, such as a sea, ocean, or the like, having a water surface 35. The depth to which the conductors 12, 14, and 16 penetrate the soil 33 is determined in accordance with conventional design criteria and may range from about 40 feet to about 120 feet and, typically, ranges from about 60 feet to about 100 feet. The spacing of the conductors 12, 14, and 16 as they are embedded into the soil 33 is determined by a template 36 positioned on the surface 32. The template 36 defines three holes sized and spaced for receiving and guiding the conductors 12, 14, and 16 as they are embedded into the soil 33. Embedding conductors such as the conductors 12, 14, and 16 into the soil 33 is considered to be well known in the art and will not be discussed in detail.

The three spaced bracing elements 20, 22, and 24 are prefabricated and positioned non-horizontally between the conductors 12, 14, and 16 at various depths (or negative elevations) below the surface 35 of the body of water 34. The depths at which the bracing elements 20, 22, and 24 are positioned depend on a number of design factors such as the total depth of the body of water 34 and anticipated stress loads that the platform 10 must withstand. In a body of water 34 having a depth of, for example, 110 feet from the surface 35 to the surface 32, low ends (discussed below) of the bracing elements 20, 22, and 24 may be positioned at depths of, for example, 80 feet, 60 feet, and 30 feet, respectively. While three bracing elements are shown in FIG. 1, it is understood that any suitable number of bracing elements may be utilized. The bracing elements 20, 22, and 24 are substantially identical to each other and, for the sake of conciseness, are depicted representatively in FIG. 2 by the bracing element 20.

Figure 2:
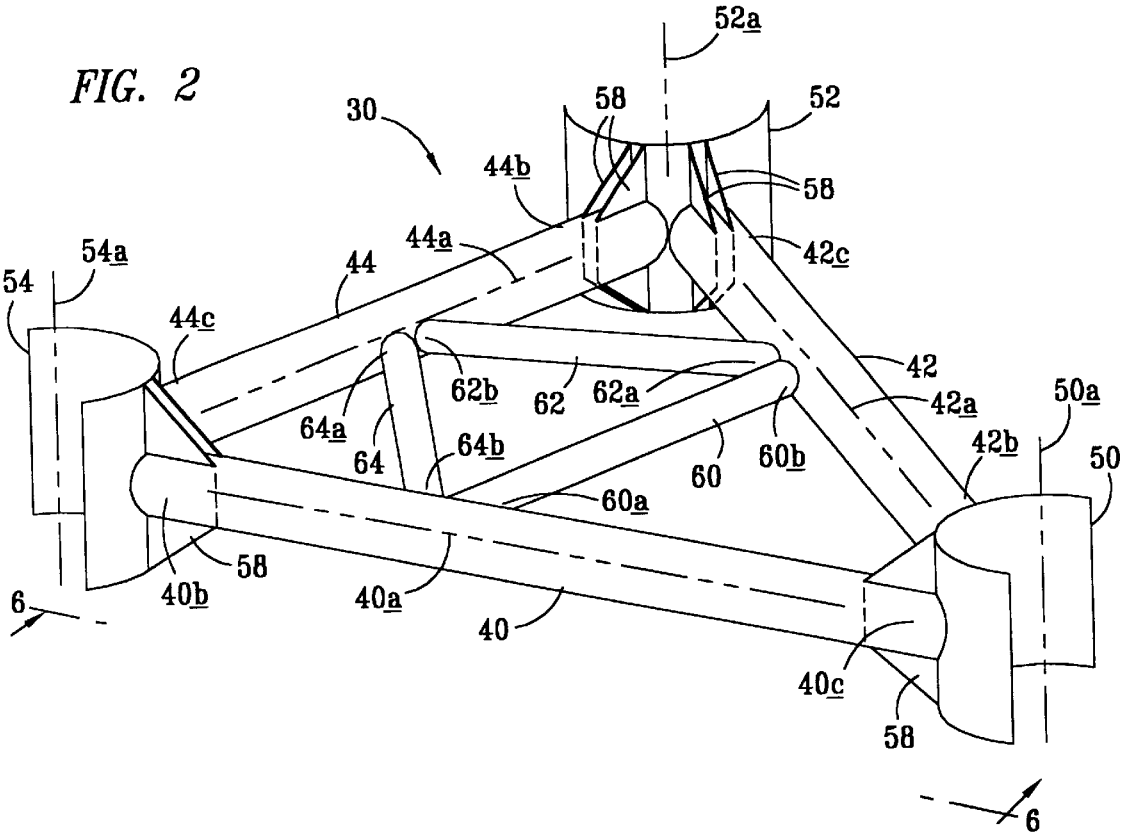
FIG. 2 is a perspective view of a bracing element utilized in the cluster platform of FIG. 1.

As depicted in FIG. 2, and in greater detail below, the bracing element 20 includes three tubular longitudinal members 40, 42, and 44 having centerlines 40*a*, 42*a*, and 44*a*, respectively, and ends 40*b*, 40*c*, and 42*b*, 42*c*, and 44*b*, 44*c*, respectively. As described in greater below, the longitudinal members 40 and 42 are welded at their respective ends 40*c* and 42*b* to a semi-cylindrical split sleeve 50; similarly, the longitudinal members 42 and 44 are welded at their respective ends 42*c* and 44*b* to a semi-cylindrical split sleeve 52; and the longitudinal members 44 and 40 are welded at their respective ends 44*c* and 40*b* to a semi-cylindrical split sleeve 54.

Figure 3:
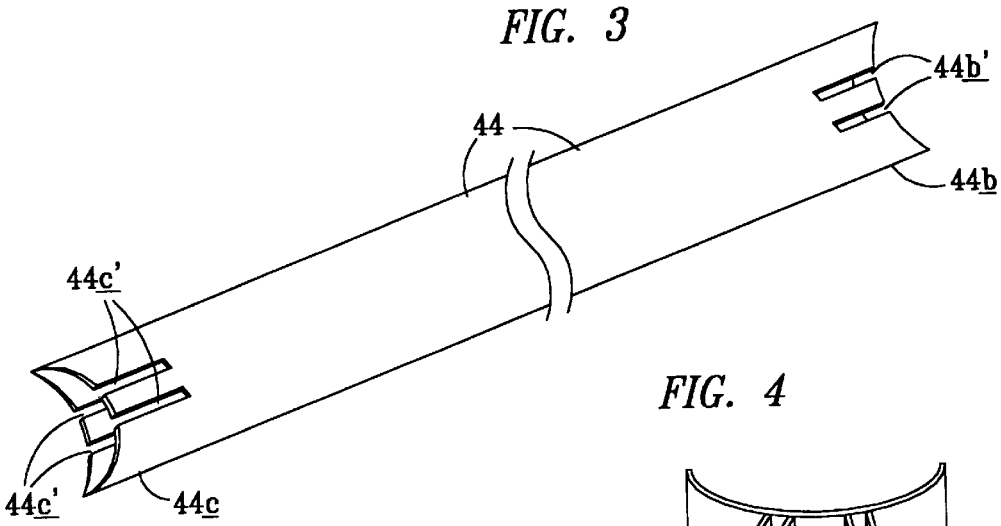
FIG. 3 is a perspective view of a longitudinal member of the bracing element of FIG. 2.

The longitudinal members 40, 42, and 44 are substantially identical to each other and, for the sake of conciseness, are depicted representatively in FIG. 3 by the longitudinal member 44. As shown in FIG. 3, the ends 44*b* and 44*c* of the longitudinal member 44 are curved for matingly engaging semi-cylindrical split sleeves 52 and 54, respectively. Each of the ends 44*b* and 44*c* define four slots 44*b*' and 44*c*' for receiving gusset plates, described below with respect to FIG. 4. While the longitudinal member 44 is depicted as preferably tubular, it may also comprise shapes having cross-sections defined, for example, by a square, a rectangle, an I-beam, or the like.

Figure 4:
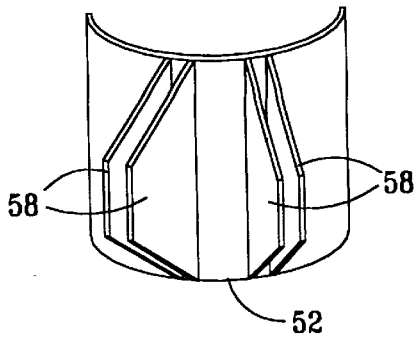
FIG. 4 is a perspective view of a semi-cylindrical split sleeve of the bracing element of FIG. 2.

The semi-cylindrical split sleeves 50, 52, and 54 are substantially identical to each other and, for the sake of conciseness, are depicted representatively in FIG. 4 by the semi-cylindrical split sleeve 52. As shown in FIG. 4, the semi-cylindrical split sleeve 54 has four, fall-depth, stiffening end gusset plates 58 welded to it. The gusset plates 58 are suitably-sized for matingly engaging the slots 42*c*' and 44*b*', respectively, defined on the ends 42*c* and 44*b*, respectively, of the longitudinal members 42 and 44, respectively, shown in FIG. 2. With reference to FIG. 2, the inside diameter of the semi-cylindrical split sleeve 52 is substantially the same as the outside diameter of the conductor 14 and, furthermore, is oriented about an axis 52*a* which is generally parallel to the centerline of the respective conductor 14 to which it is secured.

Figure 5:
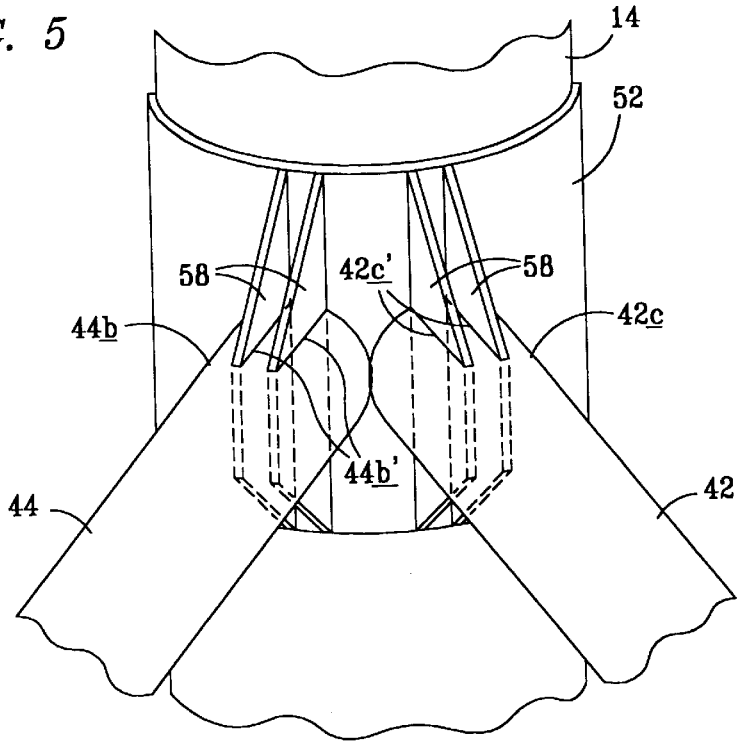
FIG. 5 shows an enlarged view of a portion of the bracing element depicted in FIG. 2 wherein the longitudinal member depicted in FIG. 3 is secured to the semi-cylindrical split sleeve depicted in FIG. 4.

FIG. 5 depicts the attachment of the longitudinal members 42 and 44 to the semi-cylindrical split sleeve 52. As shown therein, the ends 42*c* and 44*b* of the longitudinal members 42 and 44, respectively, are positioned onto the semi-cylindrical split sleeve 52 so that the end gusset plates 58 matingly engage the slots 42*c*' and 44*b*'. All points of contact between the longitudinal members 42 and 44, the gusset plates 58, and the semi-cylindrical split sleeve 52 are secured together using conventional welding techniques. Similarly, as shown in part in FIG. 2, the ends 40*c* and 42*b* of the longitudinal members 40 and 42, respectively, are secured to the split sleeve 50; and ends 44*c* and 40*b* of the longitudinal members 44 and 40, respectively, are secured to the split sleeve 54. The gusset plates 58 are preferably oriented generally parallel to centerlines 50*a*, 52*a*, and 54*a* of the semi-cylindrical split sleeves 50, 52, and 54, respectively.

Figure 6:
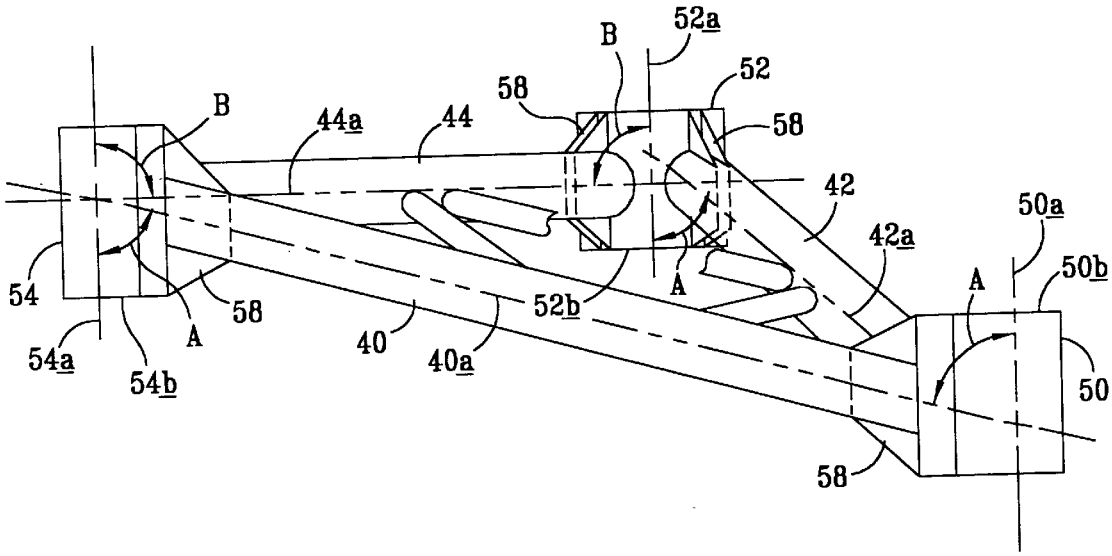
FIG. 6 is an elevation view of a bracing element depicted in FIG. 2 taken along the line 6—6 of FIG. 2.

As shown in FIG. 6, the centerlines 40*a* and 42*a* of the longitudinal members 40 and 42, respectively, are oriented relative to the centerlines 50*a*, 52*a*, and 54*a* at an angle A of from about 45° to about 85° and, typically, from about 60° to about 80° and, preferably, about 72°, so that, when the centerlines 50*a*, 52*a*, and 54*a* are substantially vertical, an upper end 50*b* of the split sleeve 50 will be lower than a lower end 52*b* of the split sleeve 52 and lower than a lower end 54*b* of the split sleeve 54, for reasons discussed below. Additionally, the centerline 44*a* of the longitudinal member 44 is oriented relative to the centerlines 52*a* and 54*a* at an angle B of about 90°, so that when the centerlines 50*a*, 52*a*, and 54*a* are substantially vertical, the centerline 44*a* is substantially horizontal. It is noted, too, that when the centerlines 50*a*, 52*a*, and 54*a* are substantially vertical, the centerlines 40*a* and 42*a* will be skewed from horizontal by an angle of 90° less the angle A.

Referring back to FIG. 2, the bracing element 20 preferably also includes, for additional structural reinforcement, three tubular cross members 60, 62, and 64 having first ends 60*a*, 62*a*, and 64*a*, respectively, and second ends 60*b*, 62*b*, and 64*b*, respectively. The first end 60*a* of the cross member 60 is welded to the longitudinal member 40 at a point intermediate the ends 40*b* and 40*c*, and the second end 60*b* of the cross member 60 is welded to the longitudinal member 42 at a point intermediate the ends 42*b* and 42*c*. The first end 62*a* of the cross member 62 is welded to the longitudinal member 42 at a point intermediate the ends 42*b* and 42*c*, and the second end 62*b* of the cross member 62 is welded to the longitudinal member 44 at a point intermediate the ends 44*b* and 44*c*. The first end 64*a* of the cross member 64 is welded to the longitudinal member 44 at a point intermediate the ends 44*b* and 44*c*, and the second end 64*b* of the cross member 64 is welded to the longitudinal member 40 at a point intermediate the ends 40*b* and 40*c*.

Capping beams (not shown) are positioned and installed atop the conductors 12, 14, and 16 and a suitable prefabricated facility production deck 80 is seated on and secured to the capping beams. The deck 80 may comprise any of a number of different configurations and may, for example, be a single level, steel framed unit configured for being seated on and secured to the capping beams. The deck 80 may further comprise all the surface facility equipment, piping, and the like necessary for production of hydrocarbons through tubing (not shown) extending through the conductors 12, 14, and 16. The deck 80 and the installation of the deck on the capping beams is considered to be well known in the art and will not be described in detail.

In accordance with a method of the present invention, the foregoing cluster platform 10 shown in FIG. 1 may be assembled by positioning the template 36 on the surface 32, and then guiding the three conductors 12, 14, and 16 through the template 36 and driving the conductors into the soil 18 until they are embedded in the soil 33 at a suitable depth as discussed above. Embedding the conductors 12, 14, and 16 into the soil 33 is considered to be well known to those skilled in the art and will not be described in detail. A work platform (not shown) is temporarily mounted, using techniques well known in the art, atop the conductors 12, 14, and 16 above the surface 35 of the body of water 34 for performing the subsequent steps discussed below.

The bracing elements 20, 22, and 24 are prefabricated prior to assembly with the cluster platform 10. The bracing element 20 is then lowered from the work platform to a desirable depth below the surface 35 of the body of water 34. The bracing element 20 is rotated so that the split sleeves 52 and 54 are elevated above the split sleeve 50 sufficiently so that the bracing element may be positioned between the conductors 12, 14, and 16 and the upper end 50*b* of the split sleeve 50 is positioned on the conductor 12 at a desired depth of, for example, 80 feet below the surface 35 of the body of water 34. The split sleeves 50 and 52 of the bracing element 20 are then rotated downwardly about the upper end 50*b* of the split sleeve 50 until all of the split sleeves 50, 52, and 54 are positioned as desired against the conductors 12, 14, and 16, respectively. The split sleeves 50, 52, and 54 are then wet welded in place to the conductors 12, 14, and 16, respectively, using wet welding techniques well know to those skilled in the art. As a result of the angle A formed between the centerline of the split sleeve 50 and the longitudinal members 40 and 42, the split sleeve 50 is positioned at a greater depth than the split sleeves 52 and 54. The depth of the split sleeve 50 may, for example, be four feet deeper than the split sleeves 52 and 54. The remaining two bracing elements 22 and 24 are positioned between and wet welded to the conductors 12, 14, and 16 in a manner similar to that described with respect to the foregoing bracing element 20, and will therefore, not be described in detail.

After the bracing elements 20, 22, and 24 are secured in place between the conductors 12, 14, and 16, the work platform is removed, the capping beams (not shown) are installed, and the facility production deck 80 is seated on and secured to the capping beams in a manner well known to those skilled in the art. The deck 80 and the conductors 12, 14, and 16 may then be used in a well known manner to drill and complete production wells, install well heads, pipelines, etc.

By the use of the present invention, cluster platforms such as the platform 10 may be put in place and assembled in much less time and at much less expense than is required to place and assemble platforms using conventional methods and devices. It has also been determined that the cluster platform 10 provides as much structural strength and integrity as conventional platforms provide. By fabricating the bracing elements 20, 22, and 24 so that two of the longitudinal members 40 and 42 on each bracing element are skewed at an angle with respect to the split sleeve 50, the bracing elements may be rotated into place between the conductors 12, 14, and 16 without requiring that the conductors be laterally spread or "opened out" as is required when using conventional bracing elements which utilize clamps attached to the ends thereof

Having thus described the present invention by reference to certain of its preferred embodiments, it is noted that the embodiments disclosed are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for constructing a cluster platform in a body of water, the method comprising:

a) embedding three conductors in soil underlying the body of water, the conductors extending above a water surface and being positioned at the corners of a triangular area;

b) fabricating at least one bracing element comprising three surfaces configured to matingly contact the three conductors, the three surfaces being joined by at least three longitudinal members, at least two of which are joined to each surface to configure the bracing element to a triangular configuration having the surfaces positioned to matingly contact the three conductors;

c) lowering the bracing element between the conductors with one surface beneath the other two surfaces to a selected depth;

d) maintaining the one surface at the selected depth and rotating the other surfaces downwardly relative to the one surface to position the one surface and other surfaces in contact with the conductors with the other surfaces being in engagement with the conductors above the one surface;

e) wet welding the surfaces to the conductors, so that the bracing element is wet welded to at least a first conductor of the conductors at a first elevation and wet welded to at least a second conductor at a second elevation above the first elevation; and f) securing a deck atop the conductors.

2. The method of claim 1 wherein the surfaces are fabricated as semi-cylindrical split sleeves.

3. The method of claim 1 wherein the longitudinal members are fabricated as tubular members.

4. The method of claim 2 wherein the step of fabricating further comprises welding at least one gusset plate between each longitudinal member and each split sleeve connected to the respective longitudinal member.

5. The method of claim 4 wherein the step of fabricating further comprises welding a cross-member between each pair of longitudinal members.

6. The method of claim 1 wherein the step of fabricating further comprises rigidly connecting the longitudinal members to the split sleeves so that an angle is formed between a centerline of at least one split sleeve and a centerline of at least one longitudinal member, the angle formed being less than 90°.

7. The method of claim 1 wherein the angle formed is from about 45° to about 85°.

* * * * *

UNITED STATES PATENT AND TRADEMARK OFFICE

CERTIFICATE OF CORRECTION

PATENT NO. : 6,039,507

DATED : March 21, 2000

INVENTOR(S) : Kevin Kennelly, Ian Gardiner, David Noble, Achmad R. Muliadiredja

It is certified that error appears in the above-identified patent and that said Letters Patent is hereby corrected as shown below:

| Col. | Line | |
|---|---|---|
| 3 | 5 | "described in greater below,"<br><br>should read:<br>"described in greater detail below," |
| 3 | 29 | "54 has four, fall-depth,"<br><br>should read:<br>"54 has four, full-depth," |
| 4 | 67 | "techniques well know to"<br><br>should read:<br>"techniques well known to" |

UNITED STATES PATENT AND TRADEMARK OFFICE

CERTIFICATE OF CORRECTION

PATENT NO. : 6,039,507

DATED : March 21, 2000

INVENTOR(S) : Kevin Kennelly, Ian Gardiner, David Noble, Achmad R. Muliadiredja

It is certified that error appears in the above-identified patent and that said Letters Patent is hereby corrected as shown below:

| Col. | Line | |
|---|---|---|
| 5 | 33 | "the ends thereof"<br><br>should read:<br>"the ends thereof." |

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*